US010359265B2

(12) United States Patent
Van Wyk et al.

(10) Patent No.: US 10,359,265 B2
(45) Date of Patent: Jul. 23, 2019

(54) USE OF A REMOTELY CONTROLLED VEHICLE IN A BLASTING OPERATION

(71) Applicant: DETNET SOUTH AFRICA (PTY) LTD, Woodmead (ZA)

(72) Inventors: Riaan Van Wyk, Woodmead (ZA); Francois Venter, Woodmead (ZA); Trevor Watt, Woodmead (ZA); Chris Birkin, Woodmead (ZA); Andre Koekemoer, Woodmead (ZA); Elmar Lennox Muller, Centurion (ZA)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 310 days.

(21) Appl. No.: 15/525,996

(22) PCT Filed: Oct. 29, 2015

(86) PCT No.: PCT/ZA2015/050018

§ 371 (c)(1),
(2) Date: May 11, 2017

(87) PCT Pub. No.: WO2016/077848

PCT Pub. Date: May 19, 2016

(65) Prior Publication Data

US 2018/0299240 A1 Oct. 18, 2018

(30) Foreign Application Priority Data

Nov. 11, 2014 (ZA) ..... 2014/08222

(51) Int. Cl.
*F42D 3/00* (2006.01)
*F42D 5/00* (2006.01)
(Continued)

(52) U.S. Cl.
CPC ..... *F42D 5/00* (2013.01); *F42D 1/055* (2013.01); *F42D 1/08* (2013.01)

(58) Field of Classification Search
CPC ..... F42D 1/055
(Continued)

(56) References Cited

U.S. PATENT DOCUMENTS 2,717,656 A * 9/1955 Bannister ..... G01V 1/047 102/311
2008/0083320 A1* 4/2008 Chang ..... F41H 11/16 89/1.13

(Continued)

FOREIGN PATENT DOCUMENTS

DE 3729140 3/1989
DE 19502185 8/1996

(Continued)

OTHER PUBLICATIONS

International Search Report and Written Opinion for Application No. PCT/ZA2015/050018 dated Jun. 30, 2016 (10 pages).

(Continued)

*Primary Examiner* — Gabriel J. Klein
(74) *Attorney, Agent, or Firm* — Michael Best & Friedrich LLP

(57) ABSTRACT

A blasting system including a plurality of detonators located in respective boreholes, which is implemented through the use of a remotely controlled vehicle used for survey purposes and for locating geographical positions of the boreholes.

14 Claims, 6 Drawing Sheets

(51) Int. Cl.
*F42D 1/055* (2006.01)
*F42D 1/08* (2006.01)

(58) Field of Classification Search
USPC ..... 102/311, 312
See application file for complete search history.

(56) References Cited

U.S. PATENT DOCUMENTS

| | | | | |
|---|---|---|---|---|
| 2010/0225155 | A1* | 9/2010 | Spathis | E21C 37/16 299/13 |
| 2018/0224262 | A1* | 8/2018 | Klein | F41H 11/02 |

FOREIGN PATENT DOCUMENTS

| | | | | |
|---|---|---|---|---|
| DE | 102012020068 | | 4/2014 | |
| EP | 2977318 | A1 * | 1/2016 | B64C 39/024 |
| WO | 8001511 | | 1/1980 | |
| WO | WO-8001511 | A1 * | 7/1980 | F42D 3/00 |
| WO | 03042626 | | 5/2003 | |
| WO | WO-2015073687 | A1 * | 5/2015 | B64C 39/024 |

OTHER PUBLICATIONS

International Preliminary Report on Patentability for Application No. PCT/ZA2015/050018 dated Nov. 7, 2016 (14 pages).

* cited by examiner

USE OF A REMOTELY CONTROLLED VEHICLE IN A BLASTING OPERATION

CROSS-REFERENCE TO RELATED APPLICATIONS

This patent application is a national stage filing under 35 U.S.C. 371 of International Patent Application No. PCT/ZA2015/050018, filed Oct. 29, 2015, which claims priority to South African Patent Application No. 2014/08222, filed Nov. 11, 2014, each of which is incorporated herein by reference in its entirety.

BACKGROUND OF THE INVENTION

This invention relates generally to the implementation of a blasting system.

A blasting site can include hundreds or thousands of detonators spread over a substantial geographical area. To establish the site a plurality of boreholes are formed into the ground at predetermined positions and subsequently each borehole is charged with explosive in which at least one detonator is located. The detonators may be interconnected by means of wired links (conductors) or use may be made of a so-called 'wireless system' wherein low frequency signals, which can communicate with the detonators, are propagated through the earth.

Substantial care must be exercised in preparing a blast site and in implementing a blasting process. The various steps in the blasting process must be looked at continuously and reconsidered as appropriate to ensure that each hole is correctly charged with explosive and is correctly connected to a blasting network. Wires which lead to the individual detonators must be protected from damage. It is of paramount importance that blast personnel should not inadvertently be exposed to situations in which injury or death could occur.

Various detailed protocols have been designed to insure that the blasting process is effectively and safely implemented. Nonetheless errors do occur and such errors can have unpleasant results. Preferably the use of personnel at a site should be reduced as far as is possible. Also, if faults are detected before ignition takes place, some form of remedial action should be carried out.

Apart from the aforegoing factors which pertain generally to the preparation of a blasting site and the firing process itself, it is desirable to have some indication of the manner in which the blasting process actually takes place, i.e. to have a real time record which shows how blasting occurs and the effects thereof. This allows improved blasting procedures to be developed.

An object of the present invention is to address, at least to some extent, some of the aforementioned factors.

SUMMARY OF THE INVENTION

In a broad sense the invention provides a method of implementing a blasting system, which includes a plurality of detonators and a plurality of boreholes at a blast site, wherein at least one remotely controlled vehicle (RCV) is employed to control at least one aspect of the blasting system.

As used herein "RCV" means an unmanned remotely controlled vehicle which may be a terrestrial vehicle (TV) or an aerial vehicle (AV). It is also possible according to requirement to make use of a TV in combination with an AV.

It falls within the scope of the invention for the AV to be a balloon-type vehicle which may be driven or propelled by means of one or more drive engines. It is possible to make use of a number of RCVs operated individually or in a squadron format, under the control of suitable control techniques e.g. custom-written software, to control simultaneously or sequentially aspects of the blasting process.

A primary objective of making use of at least one RCV is to reduce the number of personnel required on a blast site. This increases the safety of operation. Another major objective is to make use of a RCV to obtain more accurate data to ensure that a blasting process is carried out more effectively.

According to a first aspect of the invention at least one RCV is used to survey a blast site to determine geographical parameters pertaining to the site. In response to that survey, using custom-written software which is executed remotely or on board the RCV, positional data pertaining to each of a plurality of boreholes may be determined. The RCV may then be controlled autonomously or by means of a control unit to mark each intended location of each borehole.

The RCV, despite being remotely controllable at least to some extent, by an operator, may also possess a substantial capability of autonomous functionality i.e. the RCV may be capable of carrying out various operations, generally independently of real time control under the watch of a supervisor, but functioning in terms of operating protocols or sequences embodied in control software of firmware in or on the RCV, or held, say, in a control operator at a remote location—in this instance the RCV and the control computer can interact, and communicate with each other, via suitable radio links.

Alternatively if data pertaining to the borehole locations has been determined by other means (e.g. through the use of a GPS during borehole drilling, or during the loading of boreholes with explosives), then the RCV may be used to identify a physical position of each borehole. Optical recognition software can be used to locate and verify, accurately, the position of each borehole which has already been prepared.

In a preferred form of the invention an RCV is employed to mark the location of each intended borehole. Preferably the marking is effected in a physical manner. For example the RCV may be controlled, by using suitable guidance programs, to traverse the blast site and, at each location which has been identified for a respective intended borehole, to deposit or make an appropriate mark. The RCV may for example deposit a radio beacon which includes a transponder which can be interrogated by means of a device on a drilling vehicle so that the marker location can be accurately identified. It is preferred, though, to equip the RCV so that, at an identified location, the RCV can make an indelible mark on the ground which subsequently is used to guide the positioning of a drilling machine so that a borehole can be made at the marked location. The RCV may for example carry dye, paint or the like and may be operated to mark the ground with the dye or paint in a manner which facilitates the precise positioning of a machine, at the location, used to form a borehole at the site.

Once the boreholes have been formed it falls within the scope of the invention for an RCV to be employed to survey the blast site and to determine or validate the geographical position of each borehole. This positional data can be checked against designed positional data, and if any deviations occur, new positional data can be used in a control program to vary blasting parameters to ensure that original objectives which may have been based on a different blasting layout can still be efficiently achieved.

The blast site can take on different forms. In one technique individual detonators, placed in the various blast holes, are interconnected by means of wires which run at least on the surface to a blasting machine. Terrain at the blasting site can thus be traversed by a plurality of conductors and, when explosive materials are loaded into the individual blast holes, it is quite possible that vehicles which transport the explosive materials could damage or sever the conductors. To address this aspect it falls within the scope of the invention for an RCV, and particularly an AV, to be employed to sense the path of each conductor during a survey of the blast site. Through the use of appropriate software a clear route for a vehicle to deliver explosive to each blast hole can be determined. This vehicle, itself, could be a TV i.e. a ground-based remotely controlled vehicle. Guidance information can then be transmitted via or from an AV to a driver of each vehicle, or to a TV which is remotely or at least partly, autonomously, controlled (without an on-board driver) to ensure that during explosive material delivery, the delivering vehicle does not ride over a conductor. The integrity of the blasting system can, in this respect, be safeguarded.

It further falls within the scope of the invention for the RCV to be equipped with appropriate sensors which can detect that each borehole has been loaded with explosive.

The RCV, particularly in the form of an AV, may be employed as a repeater station to transmit information between a control unit, e.g. a blasting machine, and each detonator in the blasting system. This information may include data, commands and the like necessary for checking the integrity of each detonator connection, the status of a borehole at the blast site which is loaded with explosive material, to transfer timing data and identity information between the control unit and each detonator and, ultimately, to relay firing signals from the control unit to each detonator.

In the last mentioned case if the detonators are interconnected by means of surface wires then the RCV may include a transmitter which functions at a suitable frequency and which transmits a broadcast signal which is induced into the wires and relayed to the individual detonators.

It also falls within the scope of the invention for a detonator, located inside an explosive charge in a borehole, to be connected by one or more optical fibre links to a respective receiver/transmitter transducer positioned on surface. An RCV using encoded light signals, is able to communicate uniquely and directly with each transducer as it traverses the blast site particularly if the RCV is an AV and is overhead. Conversely, data from each detonator can be relayed via the transducer to the AV (say) using coded light signals. Typically this would be in response to an interrogating coded signal sent while the AV is above the transmitter/receiver transducer which is connected to the respective detonator.

In another variation of the invention each borehole includes conductive material which is capable of relaying a signal between surface and a detonator located with the explosive material inside the borehole. The explosive material may, itself, include a conductive ingredient or element to facilitate this process. This approach allows the use of interconnecting wires between the various detonators in a blasting system to be eliminated. Firing of the detonators may be effected by means of a signal broadcast from an RCV to all of the boreholes simultaneously—suitable control signals are then induced into the conductive material in each of the boreholes, and transmitted to the respective detonators.

Apart from the surveying aspects referred to, an RCV can be used to deliver equipment, to each borehole, which may be required to establish the blasting system. Thus, for example an RCV could be used to deposit detonators at respective boreholes, to deploy conductors (electrical, optical, or any other form), between boreholes and a blasting machine, deliver connectors to boreholes, and the like. Also once a blasting system has been established it is necessary to test the system in order to verify the integrity thereof. Usually this is done by an operator working through the medium of a blasting machine which is connected to the detonators which are installed in the various boreholes. If any fault or defect is detected remedial action is required.

An RCV, particularly a TV, could be advantageously employed in this respect e.g. the TV could be directed to follow a predetermined route to a particular borehole and then, by using suitable recognition software, remove or isolate a faulty detonator or take other appropriate action.

BRIEF DESCRIPTION OF THE DRAWINGS

The invention is further described by way of examples with reference to the accompanying drawings in which.

DESCRIPTION OF PREFERRED EMBODIMENT

Figure 1:
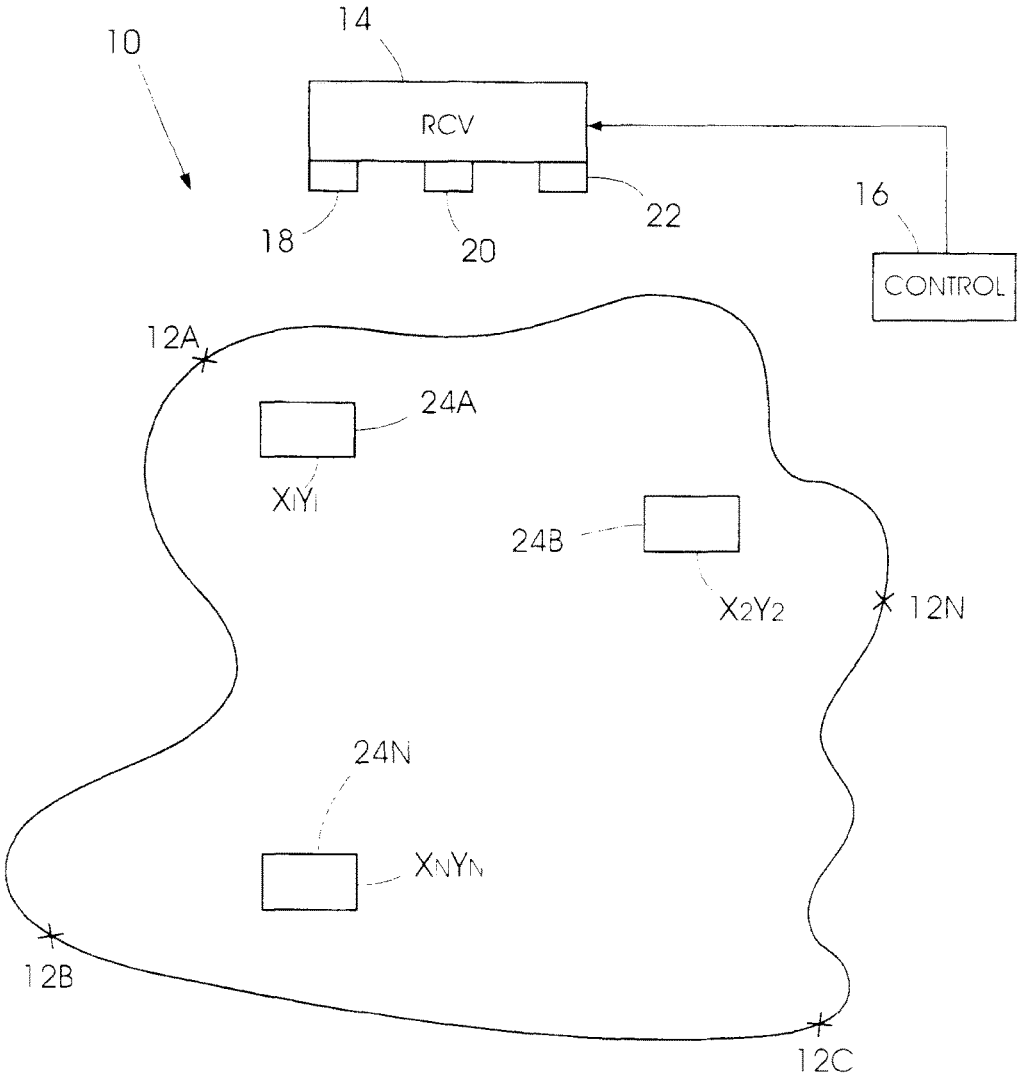
FIG. 1 illustrates the use of a single RCV for implementing a blasting process at a blast site.

FIG. 1 illustrates a blast site 10 which has geographical boundaries 12A, 12B, 12C . . . 12N, separately determined beforehand, bounding the blast site. At least one RCV 14 is used to survey the site. The RCV may be a TV but, preferably, for survey purposes the RCV is an AV and may be a fixed wing aircraft, a delta wing aircraft or comprise a helicopter with one or more rotors. It is also possible to make use of a balloon, inflated for example with helium which is driven by one or more engines to traverse the site. If the AV is sufficiently high above the site the extent of movement required of the AV relative to the site may be substantially reduced or even eliminated. The AV is controlled using appropriate radio signals from a remote control site 16 using techniques which are known in the art.

It is also possible to construct the RCV (AV or TV) to function substantially autonomously so that a region bounded by the beacons is surveyed essentially automatically. The RCV, to carry out the surveying process, is equipped with optical sensors 18, radar 20 and distance measuring equipment 22 which may function at radar, optical, infrared or ultrasonic frequencies. The invention is not limited in this respect.

The RCV 14 traverses and surveys the site 10 and determines positions 24A . . . 24N for each respective borehole to be formed at the site. Geographical coordinates $x_1$, $y_1$, $x_2$ $y_2$, . . . $x_n$ $y_n$ for each respective position are determined. These coordinates can be determined directly by the RCV though the use of appropriate software or may have been determined beforehand from suitable surveying and sensing techniques. In the latter case data pertaining to the geographical position of each intended borehole is transferred to the RCV. In the former case such geographical data is determined by means of software operated in response to survey data produced by the RCV.

Figure 2:
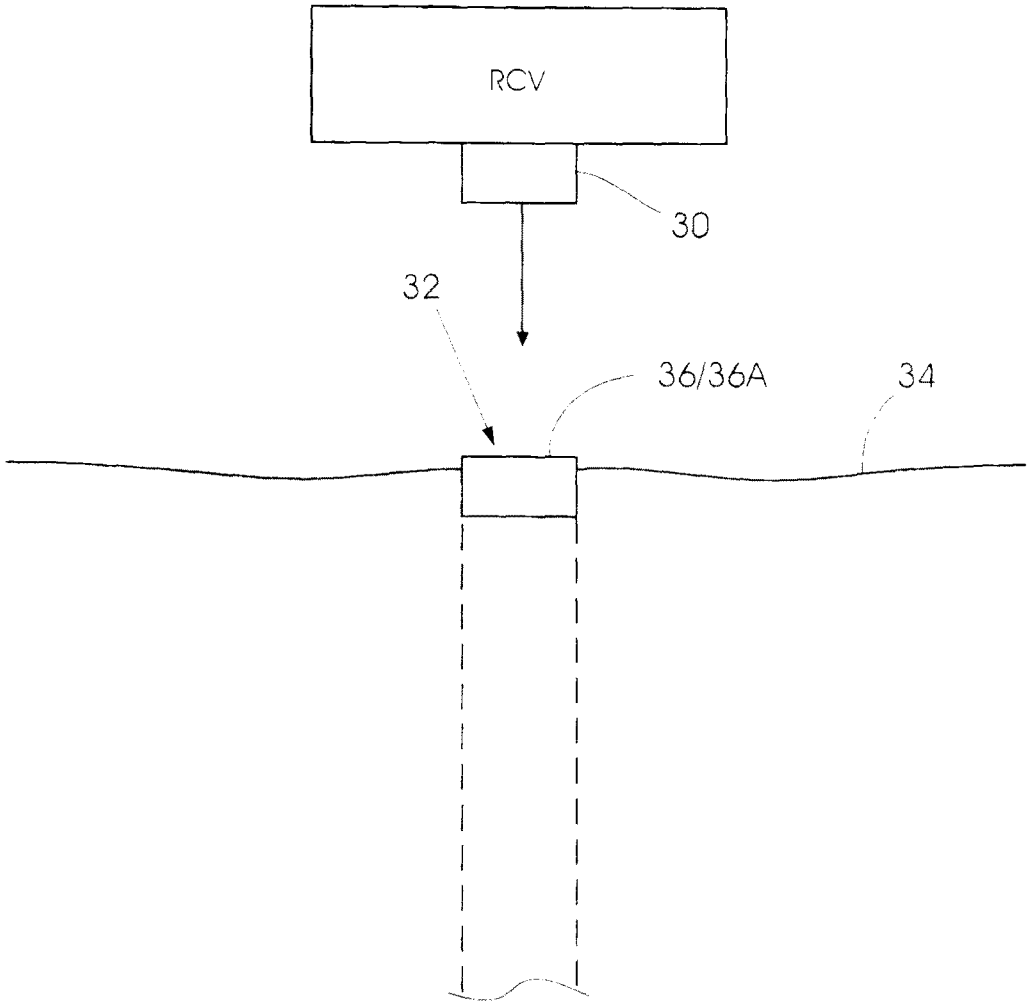
FIG. 2 is a schematic representation of an RCV making a mark at a blast site to facilitate the drilling of a borehole.

FIG. 2 illustrates the RCV 14 equipped with marking apparatus 30, positioned at an intended borehole location 32 on the ground 34. The location 32, initially, is known only from its geographical coordinates $x_n$ $y_n$. The RCV is automatically guided to the location and is then used to mark the position of the site on the ground. This can be done in any appropriate way. In one technique a transponder 36 is deposited by the RCV on the ground using the marking apparatus 30. The transponder is encoded and, if it is subsequently interrogated by appropriate equipment carried by a drilling machine, it can identify (announce) its position and its identity. In an alternative approach the marking apparatus 30 deposits paint or a dye or any suitable marking device such as a reflector 36A onto the ground. The paint, dye, reflector etc., as appropriate, may carry identity data which is visually or remotely ascertainable by a person using or operating a drilling machine.

Through the use of the technique shown in FIG. 2 it is possible for the site 10 to be marked precisely with a plurality of locations at each of which a respective borehole is to be drilled.

Figure 3:
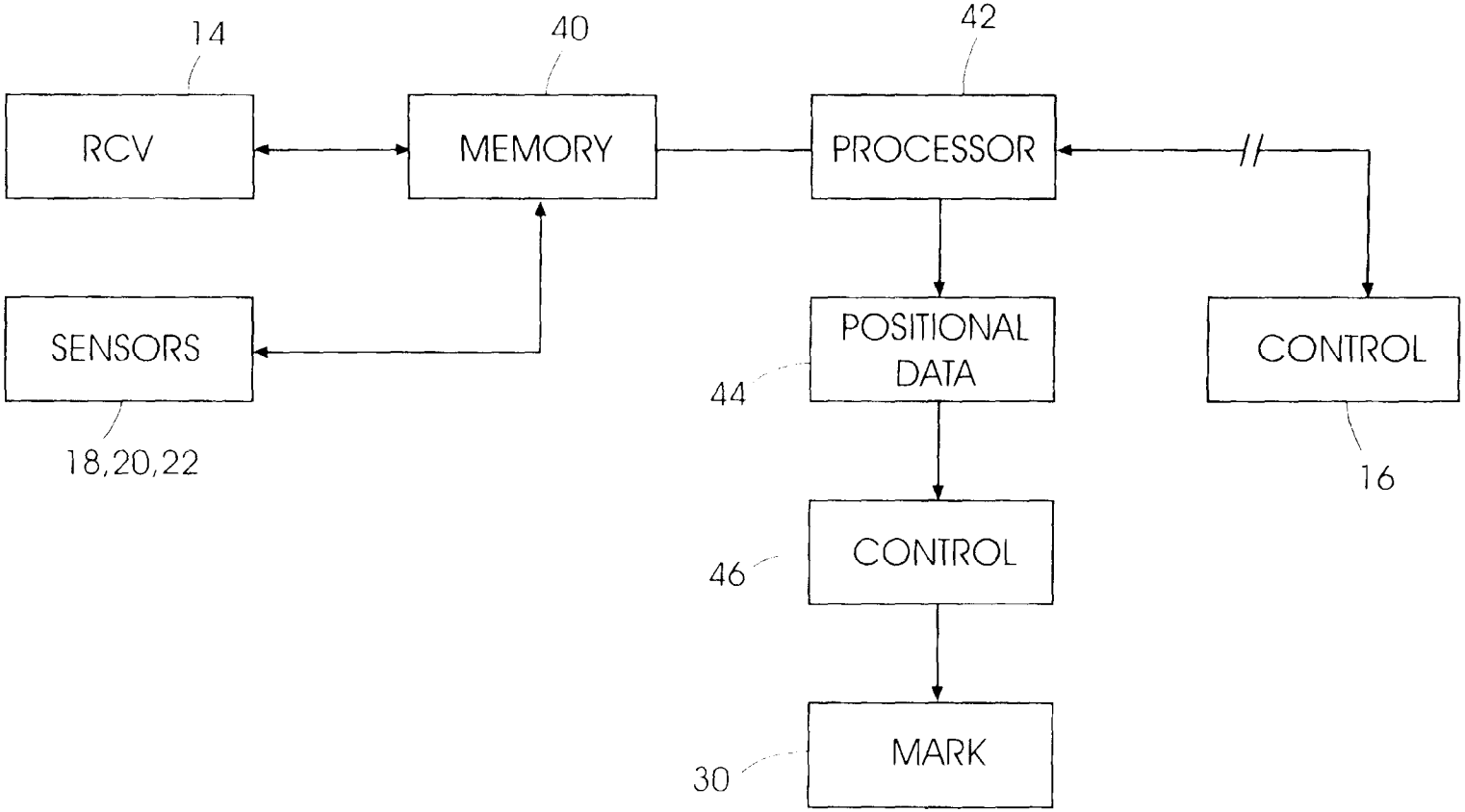
FIGS. 3 to 6 are block diagram representations of different aspects of the invention.

FIG. 3 schematically depicts the RCV 14 and the plurality of sensors 18, 20, 22 etc. The RCV includes a memory 40 and a processor 42 which is responsive to signals transmitted from the control unit 16 (see FIG. 1).

The processor, in response to data produced by the sensors, can generate positional data 44. Alternatively, the control unit can transmit positional data to the processor.

The positional data is used to regulate the movement of the RCV when borehole marking is to be carried out as shown in FIG. 2. Thus the positional data, used as input parameters to the processor, functions to control (46) the movement and position of the RCV and, at the appropriate time, the marking apparatus 30 is actuated to mark the ground to indicate a borehole position.

Figure 4:
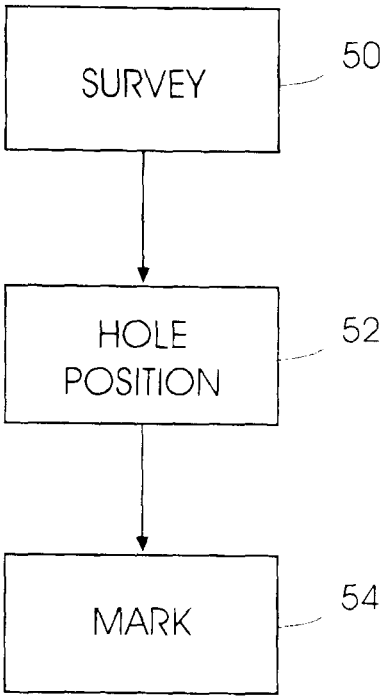

FIG. 4 schematically illustrates the aforementioned process. In an initial step 50 the site 10 is surveyed and the data on borehole positions 52 is produced or fed to the RCV. Subsequently marking 54 takes place in the manner described in connection with FIG. 2.

Once the various boreholes have been drilled at the indicated positions the RCV 14 is used to resurvey the blast site (step 56) and the measured positions of the actual boreholes are compared to planned or predetermined positions so that the data used in the blasting software can if necessary be validated (step 58).

To the extent that may be applicable remedial action 60 is taken in that the blasting control software is revised or adapted according to the fresh data input.

Figure 5:
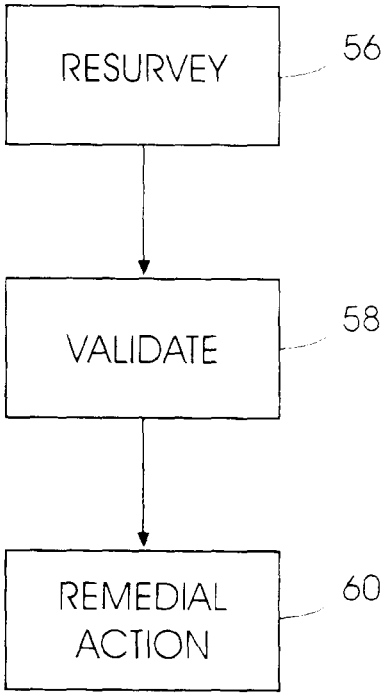
Figure 6:
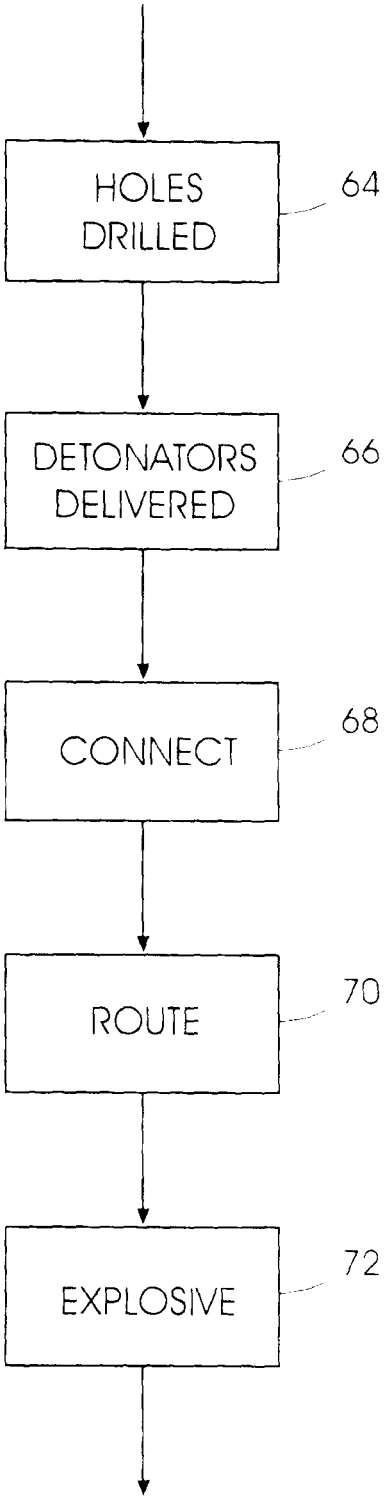

FIG. 6 illustrates a sequence of operations, again implemented through the use of the RCV. Boreholes 64 which have been drilled are resurveyed as has been described in connection with FIG. 5. Thereafter the RCV is employed to deliver detonators (step 66) to the individual boreholes. Alternatively, if the detonators are delivered to the boreholes by other means, the RCV is employed to detect that the detonators are, as a matter of fact, at the respective boreholes.

Depending on the nature of the blasting system the detonators are then interconnected using appropriate techniques (step 68). The RCV could be used to map the routes which have to be followed by conductors which are to be employed to interconnect the detonators, and which are to connect the detonators to a blasting machine. The mapping is preferably done, following an aerial survey conducted by an AV, to determine an optimum way to deploy conductors between the detonators etc., as may be required for the blasting system.

Figure 7:
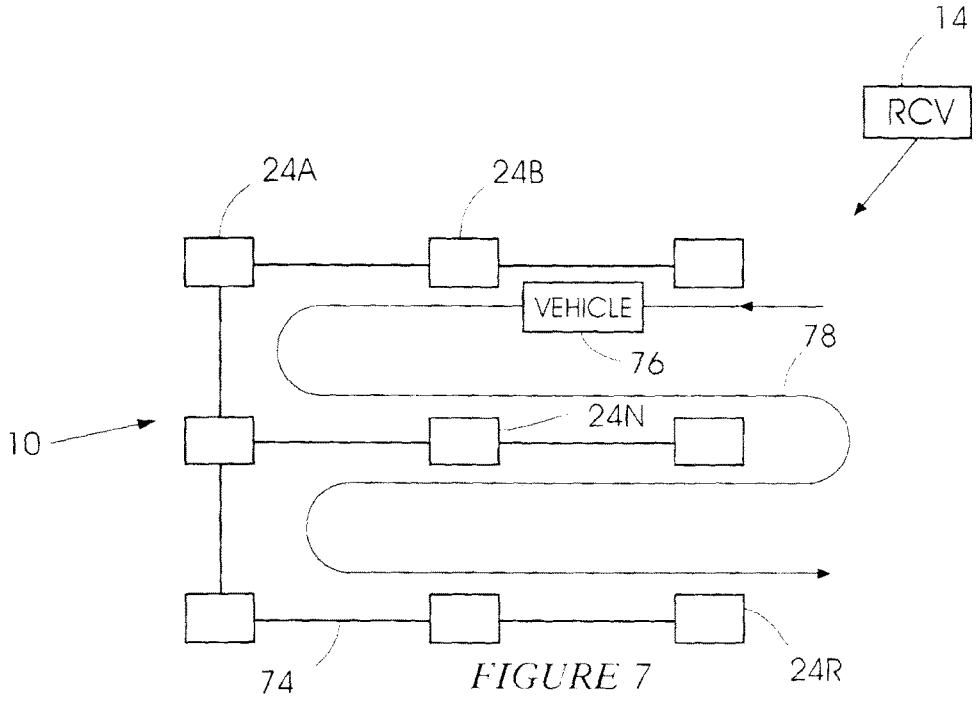
FIG. 7 illustrates the implementation of a guidance system using the principles of the invention.

After appropriate connections have been made to the detonators, the route map referred to can be used to control the delivery of explosive material to each borehole (72). This delivery may be done using a manned vehicle i.e. with a driver in the vehicle but the delivery may also be accomplished using an unmanned vehicle i.e. a TV which drives, substantially autonomously, between delivery sites. At each site a technician would normally be available to receive the explosive material, and to ensure the explosive material is correctly placed into a borehole. This process, correctly implemented and adhered to, reduces the likelihood that a vehicle could cross over and so damage, a connecting conductor which is positioned on the ground. For example FIG. 7, illustrates a number of boreholes 24A, 24B . . . 24N which have respective detonators, not shown, interconnected to one another by means of conductors 74 which lie on the ground. A vehicle 76 (which may be manned, or unmanned i.e. a TV) is directed by means of directional information transmitted, preferably from an AV 14, to follow a route 78 which goes to all of the boreholes but which does not cross any of the conductors 74.

Figure 8:
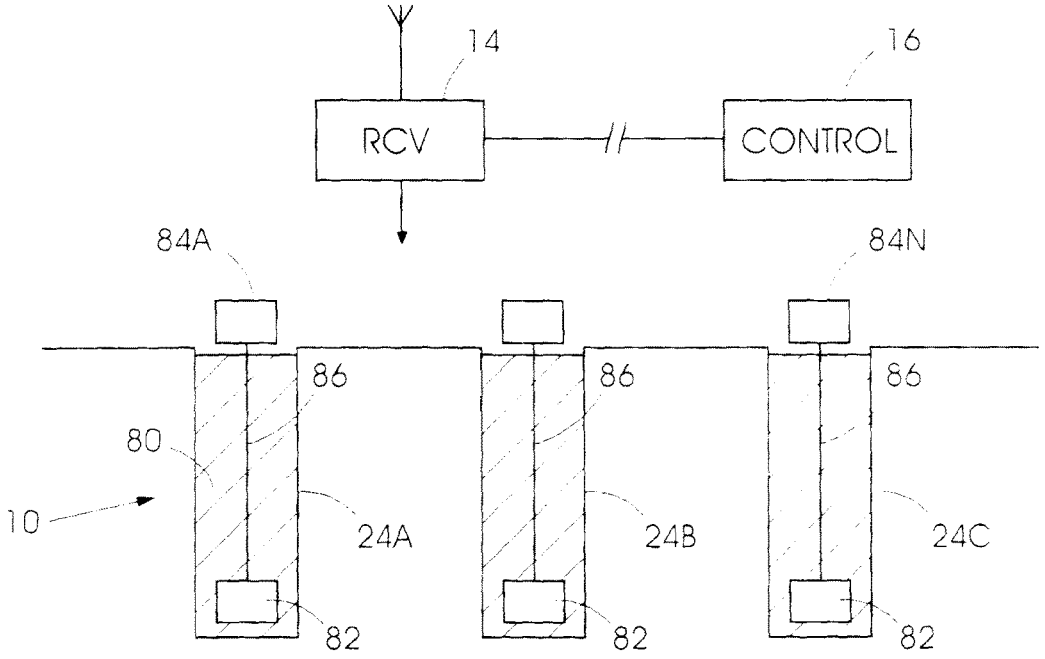
FIG. 8 depicts another aspect of the invention.

FIG. 8 illustrates a number of boreholes 24A, 24B . . . 24N, at the site 10, which are charged with explosive material 80. A respective detonator 82, loaded into the explosive material in each borehole, is connected to a receiver/transmitter transducer 84A, 84N by means of a respective lead 86. The transducers 84 are on the surface.

The various transmitter/receiver units 84 are not connected to one another nor to a blasting machine. When an AV 14 overflies the site it can use encoded signals to interrogate each transducer and in this way elicit a response from the associated detonator. Data intended for each detonator is transmitted in the reverse direction by the AV to the transducer and then to the detonator. This process allows the integrity and status of each detonator to be ascertained and allows for unique timing data to be transmitted to each detonator in preparation for the execution of a blasting routine. If blasting is to take place one signal is broadcast by the AV 14 to all of the transmitter/receiver units 84 simultaneously and this sets into motion the blasting process.

The conductors 86 may be electrically conductive. Alternatively use can be made of fibre-optic leads which extend from optical receiver/transmitter units 84 on the surface, to the respective detonators 82. Another possibility is to ensure that the explosive material 80 in each borehole is conductive and, where necessary, to achieve this objective a conductive ingredient or element could be added to the explosive material. This allows for signals to be transmitted directly to the respective detonators 82 and, conversely, signals transmitted by each detonator could be propagated through the conductive explosive material and received by the overflying AV.

A further function of the AV is to monitor what happens when blasting occurs. Cameras and other sensors monitor in real time the effects of blasting. It is possible, using comparative techniques based on real time visually ascertainable data, to determine whether each borehole has, in fact, been successfully ignited. Additionally the way in which a blast wave is formed and propagated, and the way in which material is dislodged at the blast site, could be assessed and information, produced in this way, could be used to modify and improve future blasting control techniques.

The integrity of a blasting system is checked, before firing takes place, to identify detonators at a blasting system which may be faulty or which are incorrectly connected to a blasting harness, or the like. An RCV, particularly a TV, could be used to access the faulty equipment and then to isolate or remove the faulty equipment from the blasting system.

The invention claimed is:

1. A method of implementing a blasting system which is to include a plurality of detonators and a plurality of boreholes at a blast site wherein the method includes the steps of using at least one remotely controlled aerial vehicle (AV) to survey the blast site to determine geographical parameters pertaining to the site in response to the survey, using custom-written software which is executed remotely or on board the AV, to determine positional data pertaining to each of a plurality of intended boreholes, using the positional data to identify a physical position of each intended borehole, and once the positional data is determined, using the AV to mark on the site the physical position of each intended borehole.

2. A method according to claim 1 wherein the physical position of each intended borehole is marked by depositing a marker which includes a transponder which can be interrogated so that the marker location can be accurately identified.

3. A method according to claim 1 wherein the AV is used to make an indelible mark on the ground which mark is subsequently used to position a drilling machine so that a borehole can be made at the marked physical position.

4. A method according to claim 1 wherein, after boreholes have been made at the blast site, an AV is employed to survey the blast site and to determine geographical data of each borehole.

5. A method according to claim 1 which include the step of using an unmanned remotely controlled vehicle (RCV) to control deployment of conductors between the boreholes, and to a blasting machine.

6. A method according to claim 5 wherein the RCV is a terrestrial vehicle (TV) which deploys the conductors from the TV.

7. A method according to claim 1 wherein a terrestrial vehicle (TV) is used to deliver of explosive material to each borehole made at the blast site.

8. A method according to claim 1 wherein the AV is equipped with sensors which are used to detect whether each borehole made at the blast site has been loaded with an explosive material.

9. A method according to claim 1 which includes the step of using an AV as a repeater station to transmit information between a blasting machine and each detonator at the blast site.

10. A method according to claim 9 wherein the information includes data, commands for checking the integrity of each detonator connection, to detect the status of a borehole at the blast site which is loaded with explosive material, to transfer timing data and identity information between the blasting machine and each detonator, and to relay firing signals from the blasting machine to each detonator.

11. A method according to claim 1 wherein the AV includes a transmitter which transmits a broadcast signal which is induced into surface wires at the blast site and which induced signal is then relayed to detonators in boreholes at the blast site.

12. A method according to claim 1 wherein the blast site includes a plurality of detonators in the respective boreholes and a respective receiver/transmitter transducer positioned on surface which is at the blast site and which is connected by one or more optical fibre links to a respective detonator, and wherein the AV is used to communicate uniquely and directly with each transducer as it traverses the blast site overhead.

13. A method according to claim 1 wherein the blast site includes a plurality of boreholes and each borehole is loaded with an explosive material, at least one respective detonator in the explosive material in each borehole and conductive material which is capable of relaying a signal between surface and the detonator, and wherein firing of the detonators is effected by means of a signal broadcast from the AV to all of the boreholes simultaneously.

14. A method according to claim 1 wherein the blast site includes a blasting machine and a plurality of detonators in respective boreholes at the blast site, and wherein the AV is used to implement remedial action to address a faulty detonator, a faulty connection between detonators, or a faulty connection between a detonator and the blasting machine.

* * * * *